US006275193B1

(12) United States Patent
Nilsen et al.

(10) Patent No.: US 6,275,193 B1
(45) Date of Patent: Aug. 14, 2001

(54) ANTENNA PROVIDING A TOUCH SCREEN STYLUS

(75) Inventors: Ryan M. Nilsen, Sunrise; Thomas A. Murray, Plantation; Alessandro Perrotta, Fort Lauderdale, all of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/449,951

(22) Filed: Nov. 29, 1999

(51) Int. Cl.[7] ..... H01Q 1/24
(52) U.S. Cl. ..... 343/702; 455/575
(58) Field of Search ..... 343/702, 906; 455/90, 575; H01Q 1/24

(56) References Cited

U.S. PATENT DOCUMENTS 5,739,793 * 4/1998 Adachi ..... 343/702

* cited by examiner

*Primary Examiner*—Michael C. Wimer
(74) *Attorney, Agent, or Firm*—Scott M. Garrett

(57) ABSTRACT

In one embodiment of the invention, an antenna (104) includes an antenna cavity used for receiving a removable stylus (108). A retention feature such as a snap (112) helps retain the stylus (108) to the antenna (104) when not in use. In an alternate embodiment, the stylus (504) is an inlay to the outer wall of antenna (506). In still another embodiment of the invention, a removable antenna stylus (300) serves as an antenna when attached to radio (404) and as a stylus when removed from the radio (404).

6 Claims, 3 Drawing Sheets

ANTENNA PROVIDING A TOUCH SCREEN STYLUS

TECHNICAL FIELD

This invention relates in general to antennas, and more specifically to an antenna providing a touch screen stylus.

BACKGROUND

Portable electronic devices with graphical user interfaces, for example, touch screen displays, require the use of a pen stylus. The pen stylus is used to input data through hand writing recognition software and/or to make selections from a screen of pre-programmed soft-keys. The stylus is a separate component un-tethered from the touch screen device and is designed to emulate a pen or other writing implement. When not in use, it is stored in a cavity or pocket into the housing of the touch screen device.

The problem with implementing this technology into a touch screen cellular telephone or radio is that a dedicated storage space or cavity must be designed into the housing of the device. This of course causes the displaced volume of the overall product to increase in order to accommodate the single function storage cavity for the stylus. Another problem that may be caused by the addition of a storage cavity and stylus is that the overall product weight of the device increases due to the additional material required.

Wearable and flip phone designs have been minimized in size to the point where the addition of a stylus storage cavity will seriously affect the overall design concept of the product. Currently, integrating a touch screen stylus into a communication device will typically increase the device's size and/or weight. Given the above, a need exists in the art for a solution to some of the previously mentioned problems.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 2:
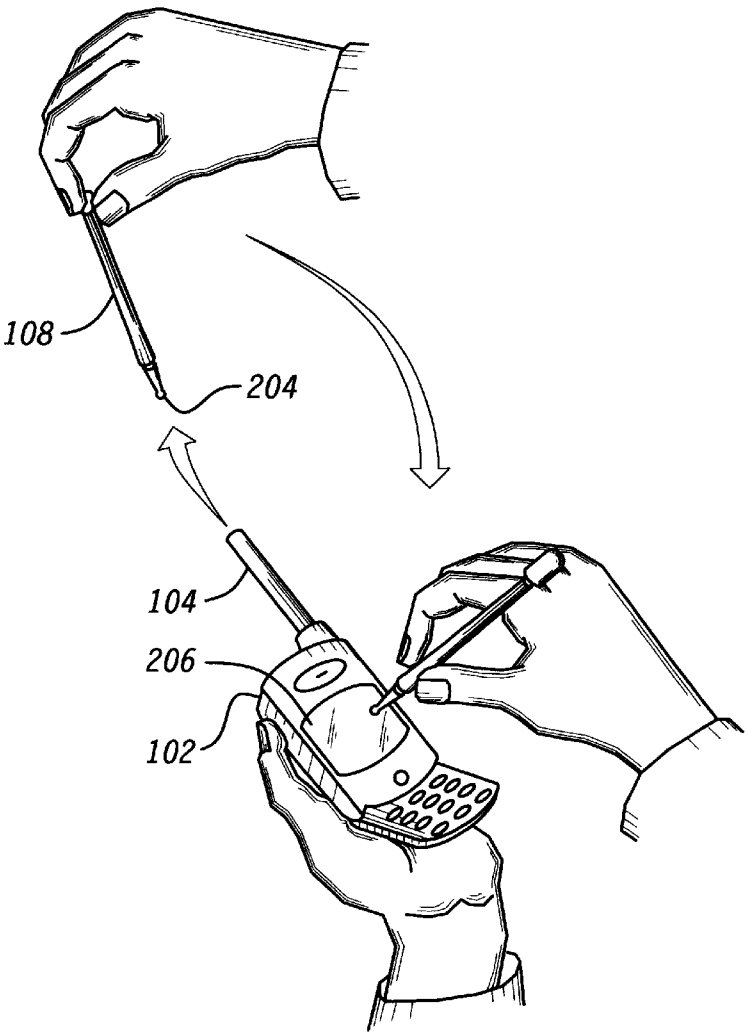
FIG. 2 shows a user removing and using the stylus of FIG. 1.

While the specification concludes with claims defining the features of the invention that are regarded as novel, it is believed that the invention will be better understood from a consideration of the following description in conjunction with the drawing figures, in which like reference numerals are carried forward.

Figure 1:
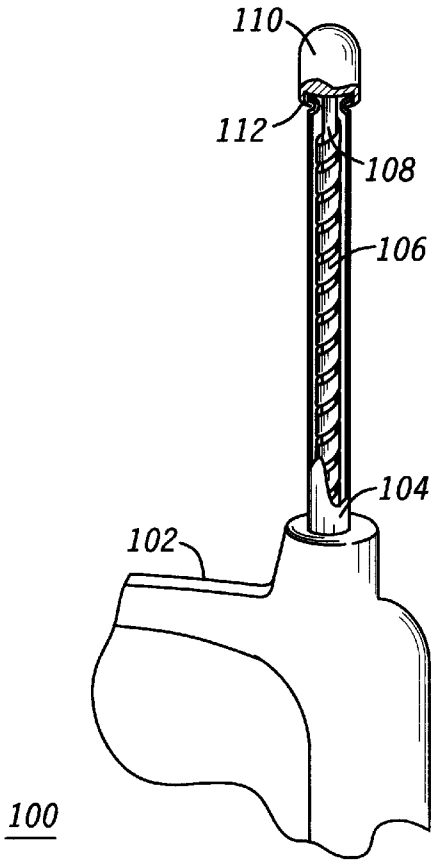
FIG. 1 shows a storage cavity integrated into the body of a communication device antenna and a stylus located in the cavity in accordance with one of the embodiments of the invention.

Referring now to FIG. 1, there is shown a communication device such as a radio (e.g., cellular telephone, two-way radio, web phone, etc.) 100 having an antenna 104 and radio housing 102. Antenna 104 includes a radiating element 106 taking the form of a coiled element. A space inside of the coiled antenna element 106 accepts a stylus 108 having a top 110. Stylus 108 is removably (capable of being detached) attached to antenna 104.

Top 110 is preferably attached to antenna 104 via an interconnect feature such as a snap fit 112. Other conventional interconnection (retention) features can also be used to retain stylus 108 attached to antenna 104 when not in use. For example, compressible rings can be included close to top 110 that can provide a pressure fit between the stylus 108 and antenna 104.

When the communication device user wants to use the stylus 104, the user grabs the top 110 and pulls upward causing the stylus 108 to be removed from antenna 104. Preferably, the end distant from top 110 has a pointed end 204 for use with touch screen display 206. As shown, the pen stylus fits comfortably in the user's hand, and when the user is finished, he can quickly store it back inside of antenna 104. Since the radio antenna 104 already had the space available due to the coiled radiating element 106, no extra space was needed to store the stylus 108.

The present invention can be used with both fixed and retractable antennas, and the stylus can be removed in both the fixed or retracted states. In the case of a radiating coil as shown in FIG. 1, the coil will encircle the stylus storage cavity, whereas a rod shaped radiating element could be molded into the antenna whip wall adjacent to the stylus storage cavity.

Figure 3:
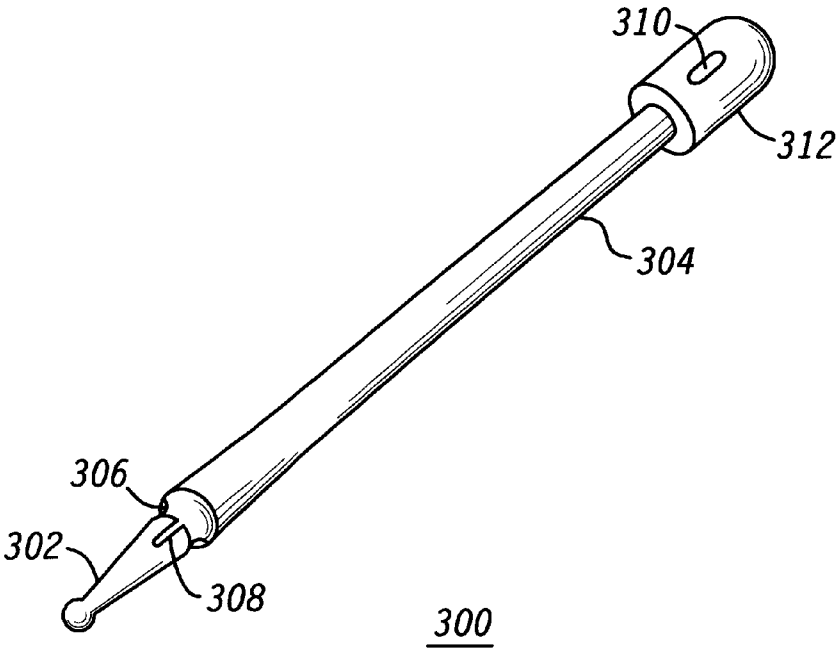
FIG. 3 shows another embodiment of the present invention in which a removable radiating element acts as a stylus when removed from the communication device.

In FIG. 3 there is shown an alternate antenna stylus 300. Stylus 300 includes a shaft 304 and a stop ring 306 and one or more lead-out grooves 308 located proximate the stylus tip 302. An antenna position indicator 310 located on top 312 is in alignment with lead-out groove 308. Indicator 310 can take many forms for example, it can be a logo such as the Motorola "bat-wing". Unlike, stylus 108 which separated from the radiating element 106, stylus 300 serves as both the radio communication device's antenna and as a stylus. Stylus 300 has the radiating element (not shown) molded into the stylus 300.

Figure 4:
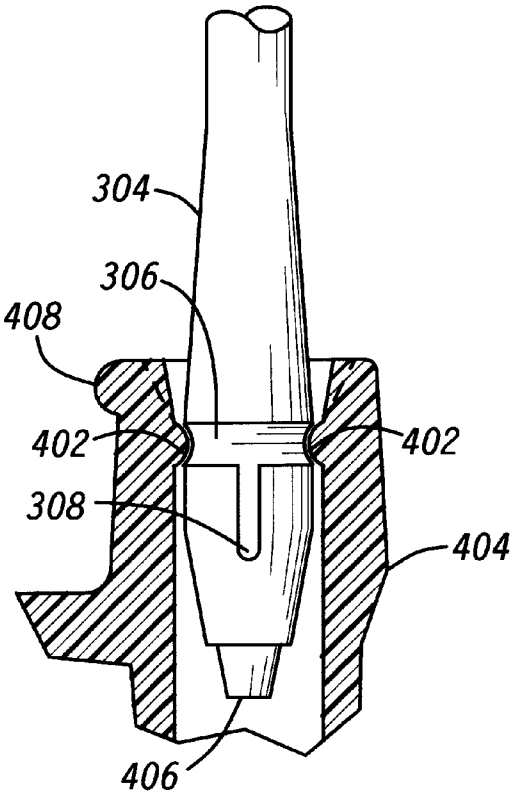
FIG. 4 shows the antenna of FIG. 3 coupled to a communication device housing.

In FIG. 4 there is shown antenna stylus 300 with the shaft 304 in the extended position. Stop ring 306 is shown mating with antenna stylus retention features 402. In order to remove the antenna stylus 300, the antenna stylus has to be rotated (about a quarter turn) so that the antenna indicator 310 becomes aligned with radio indicator 408. Once antenna indicator 310 is aligned with radio indicator 408, lead-out grooves 308 are aligned with retention features 402. This allows for the antenna stylus 300 to be easily pulled out of radio 404. When the antenna stylus 300 needs to be replaced, the antenna indicator 310 and radio indicator 408 are aligned and the antenna is pushed and turned until it again becomes captured by retention features 402. The antenna stylus 300 is shown with an alternative rubber tip 406 instead of using the pointed stylus tip 302.

Figure 6:
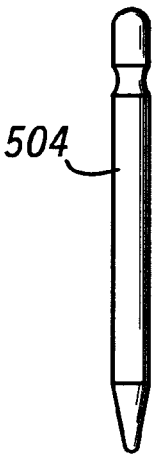
FIG. 6 shows the stylus inlay of FIG. 5 removed from the antenna body.
Figure 5:
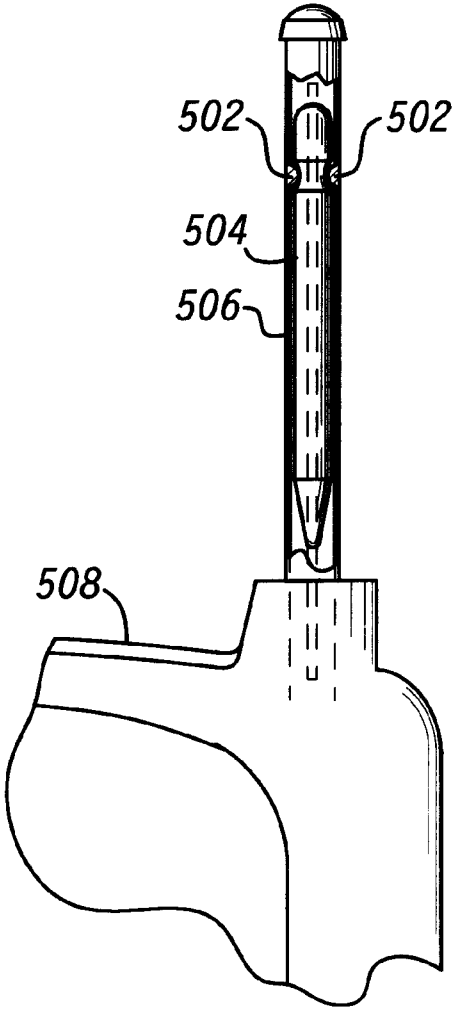
FIG. 5 shows another embodiment of the present invention in which the stylus inlays into the antenna.

Referring now to FIG. 5, there is shown another alternate embodiment of the present invention. Instead of residing in a cavity as in FIG. 1, the writing stylus 504 inlays into a recess found in the exterior wall of antenna 506. Antenna 506 is attached to radio 508. A retention feature such as a snap feature 502 helps retain the stylus 504 to the antenna wall 506. Stylus 504 is curved to match the outer wall of antenna 506. When the user wants to remove the stylus 504, he grabs the top of the stylus and pulls out until the snap feature 502 releases the stylus. In FIG. 6, stylus 504 is shown removed from antenna 506.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A communication device, comprising:

an antenna; and a stylus removably attached to the antenna;

wherein the antenna has an exterior wall having a recess, the stylus being inlaid into the recess, the stylus having no conducting element.

2. A communication device as defined in claim 1, wherein the stylus has a top having a retention feature for securing the stylus to the antenna.

3. A communication device as defined in claim 1, wherein the antenna further comprises a coiled radiating element.

4. A communication device as defined in claim 1, wherein the communication device includes a housing and the antenna is retractable into the housing.

5. A communication device as defined in claim 1, wherein the stylus has one end that is pointed.

6. A communication device as defined in claim 1, wherein the antenna includes a retention feature for securing the stylus to the exterior wall of the antenna.

* * * * *